US012048375B2

(12) United States Patent
Clark et al.

(10) Patent No.: US 12,048,375 B2
(45) Date of Patent: Jul. 30, 2024

(54) CONVERTIBLE DISPLAY AND STORAGE BIN

(71) Applicant: TARGET BRANDS, INC., Minneapolis, MN (US)

(72) Inventors: Jeremy A. Clark, Minneapolis, MN (US); Erin L Zobel, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 185 days.

(21) Appl. No.: 17/686,219

(22) Filed: Mar. 3, 2022

(65) Prior Publication Data

US 2023/0276939 A1 Sep. 7, 2023

(51) Int. Cl.
*B65D 6/24* (2006.01)
*A47B 47/00* (2006.01)
*A47F 3/00* (2006.01)

(52) U.S. Cl.
CPC ..... *A47B 47/005* (2013.01); *A47F 3/004* (2013.01); *A47B 2220/0052* (2013.01)

(58) Field of Classification Search
CPC ..... A47B 47/005; A47B 2220/0052; A47B 96/14; A47F 3/004; A47F 3/147;
(Continued)

(56) References Cited

U.S. PATENT DOCUMENTS 1,499,665 A 7/1924 Kaufman
1,832,801 A 11/1931 Wright
(Continued)

OTHER PUBLICATIONS

"Collapsible Dump Bin with Adjustable Bottom", printed from www.grand-benedicts.com/retail-merchandisers/Black-Collapsible-Dump-Bin-with-Adjustable-Bottom.asp, publicly available at least as early as May 15, 2020 (1 page).
(Continued)

*Primary Examiner* — Stephen J Castellano
(74) *Attorney, Agent, or Firm* — Griffiths & Seaton PLLC; Joann M. Seaton

(57) ABSTRACT

A collapsible storage bin comprising a base, at least two sidewalls each rotatably coupled to the base, and at least one corner rail. Each of the at least two sidewalls rotates from a storage position within the base to a use position extending out of the base. Opposing ends of each of the at least two sidewalls is formed by a channel open toward the channel of the other of the first side end and the second side end top to define a first coupling flange as part of the first side end and a second coupling flange as part of the second side end. The at least one corner rail includes a first planar segment and a second planar segment coupled edge-to-edge to each other. Each of the first planar segment and the second planar segment terminates with a return to form a different elongated reception channel open toward the other of the first planar segment and the second planar segment. The at least one corner rail selectively and slidably receives the first coupling flange of a first one of the at least two sidewalls within the elongated reception channel of the first planar segment, and the at least one corner rail selectively and slidably receives the second coupling flange of a second one of the at least two sidewalls within the elongated reception channel of the second planar segment to hold the at least two sidewalls substantially perpendicular to one another.

12 Claims, 15 Drawing Sheets

(58) Field of Classification Search
CPC ... B65D 7/32; B65D 7/30; B65D 7/26; B65D 11/1826
USPC ..... 220/6, 7
See application file for complete search history.

(56) References Cited

U.S. PATENT DOCUMENTS

| | | | | |
|---|---|---|---|---|
| 2,279,864 | A | 4/1942 | Eide | |
| 3,506,136 | A | 4/1970 | Burda et al. | |
| 3,931,894 | A | 1/1976 | Murphy | |
| 4,226,190 | A | 10/1980 | Ashton | |
| 4,969,568 | A | 11/1990 | Yoshida | |
| 5,638,973 | A * | 6/1997 | Dewey | B65D 11/1873 206/509 |
| 6,457,595 | B1 | 10/2002 | Pritchard et al. | |
| 7,611,020 | B2 | 11/2009 | Prest | |
| D668,889 | S | 10/2012 | Theisen | |
| 8,281,949 | B2 | 10/2012 | Scholen et al. | |
| 8,631,965 | B2 | 1/2014 | Leasure | |
| 10,182,650 | B1 | 1/2019 | Schenker et al. | |
| 2003/0150831 | A1 | 8/2003 | Elston | |
| 2006/0037925 | A1 | 2/2006 | Wood et al. | |
| 2006/0186072 | A1 | 8/2006 | Naruishi et al. | |
| 2012/0111819 | A1 | 5/2012 | Chung et al. | |
| 2017/0035219 | A1 | 2/2017 | Denby et al. | |

OTHER PUBLICATIONS

"Convertible Dump Bin" printed from www.lozier.com/products/freestanding-dispalys/other-freestanding-displays/convertible-dump-bin/, publicly available at least as early as May 15, 2020 (2 pages).
"Wholesale Nested Cube Tables", printed from www.sullivangift.com/NESTED-CUBE-TABLES-MET1301/, publicly available at least as early as May 15, 2020 (1 page).

* cited by examiner

CONVERTIBLE DISPLAY AND STORAGE BIN

BACKGROUND OF THE INVENTION

Retail and similar industries are continuously in need of display or storage solutions to hold products being offered for sale to consumers in a manner that is aesthetically pleasing to consumers. Display needs often are changing, which often requires one display fixture be moved into storage and another with different storage properties to be installed in its place. The fixtures not currently in use are placed in storage and take up back-room space that would ideally be reserved for products that will be offered for retail sale. As such, it is desirable and have a fixture that can be modified for multiple uses to increase the display options of a single fixture. In this way, a fixture can remain on the sales floor in a modified manner without requiring storage space and additional fixtures. The prior art also includes display fixtures that can be collapsed or knocked down to decrease the room needed for storage and/or transportation.

SUMMARY

A collapsible display bin A collapsible storage bin comprising a base, at least two sidewalls each rotatably coupled to the base, and at least one corner rail. Each of the at least two sidewalls rotates from a storage position within the base to a use position extending out of the base. Opposing ends of each of the at least two sidewalls is formed by a channel open toward the channel of the other of the first side end and the second side end top to define a first coupling flange as part of the first side end and a second coupling flange as part of the second side end. The at least one corner rail includes a first planar segment and a second planar segment coupled edge-to-edge to each other. Each of the first planar segment and the second planar segment terminates with a return to form a different elongated reception channel open toward the other of the first planar segment and the second planar segment. The at least one corner rail selectively and slidably receives the first coupling flange of a first one of the at least two sidewalls within the elongated reception channel of the first planar segment, and the at least one corner rail selectively and slidably receives the second coupling flange of a second one of the at least two sidewalls within the elongated reception channel of the second planar segment to hold the at least two sidewalls substantially perpendicular to one another. Other collapsible display bins, assemblies, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" apply to all numeric values or descriptive terms, respectively, and generally indicate a range of numbers or characteristics that one of skill in the art would consider equivalent to the recited values or terms, that is, having the same function or results.

One embodiment of this innovation provides a collapsible display bin having multiple configurations for product storage and display including self-storage of components when not in use, according to one embodiment of the present invention. For example, collapsible display bin includes a base and a plurality of sidewalls rotatably coupled to the base for selecting storage within and extension from the base. When extending from base, sidewall edges are selectively and slidably coupled to on another via a plurality of corner rails, which form the corners of the bin in an expanded configuration. When not in use, corner rails are pulled off each of the sidewall edges and stored in an integral storage shelf inside the base. In one embodiment, the plurality of sidewalls fold down to stack over the stored corner rails in a storage configuration of smaller overall size that the expanded configuration. In embodiment, collapsible display bin additionally includes an adjustable shelf and/or outside cladding, which both further increases the options of use of the collapsible display bin.

Figure 1:
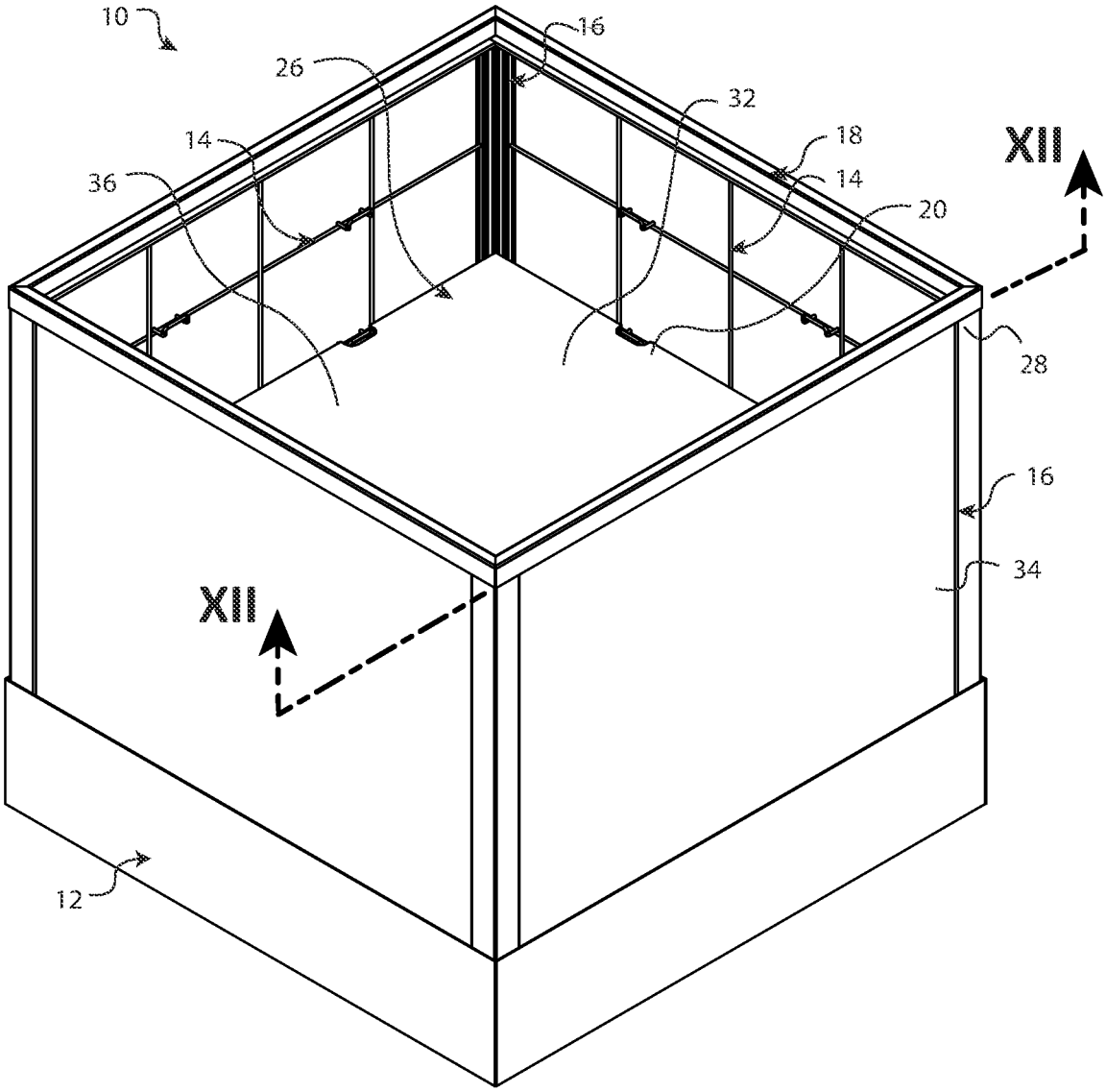
FIG. 1 is a front perspective view illustration of a collapsible display bin in a first configuration, according to one embodiment of the present invention.
Figure 2:
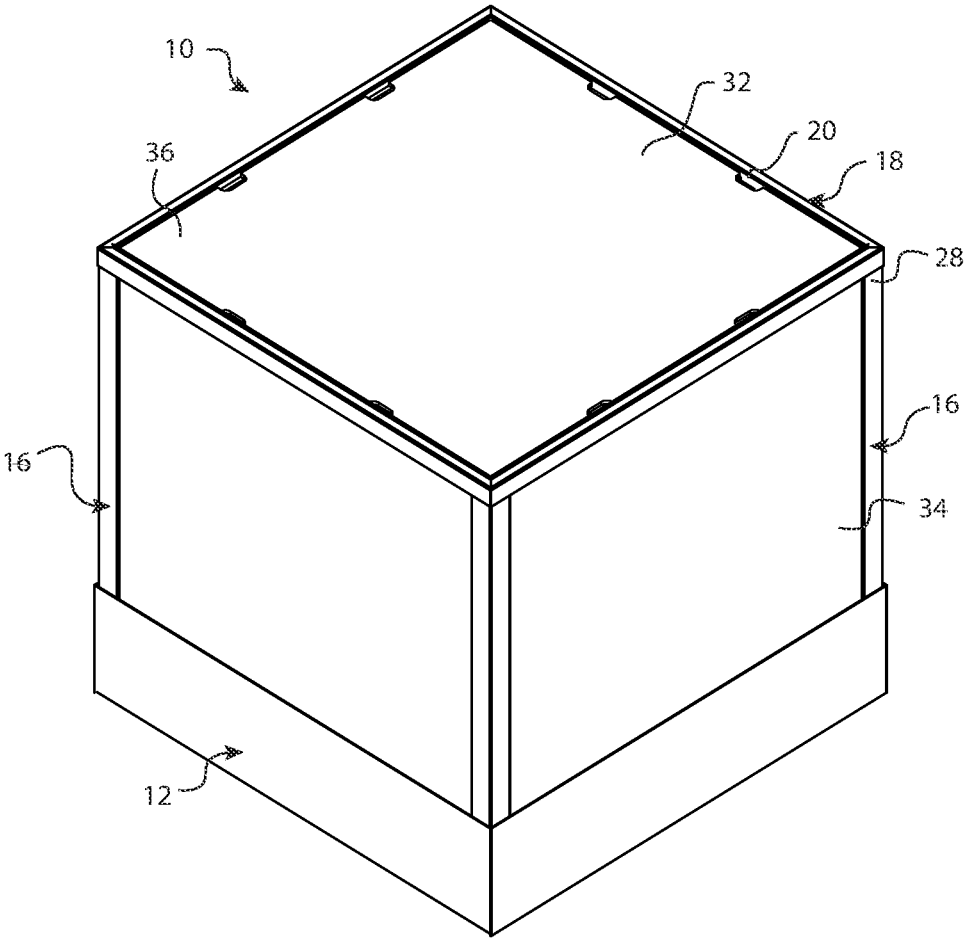
FIG. 2 is a front perspective view illustration of the collapsible display bin of FIG. 1 in a second configuration, according to one embodiment of the present invention.
Figure 3:
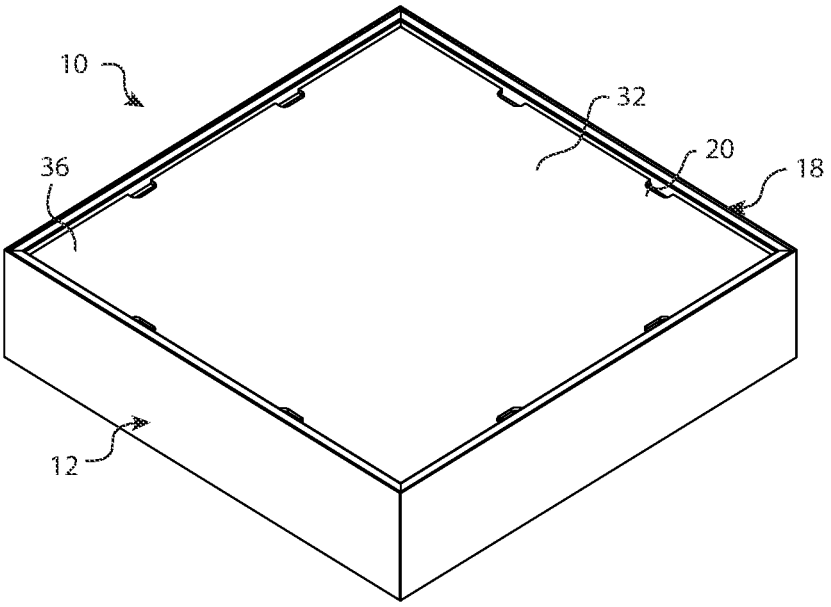
FIG. 3 is a front perspective view illustration of the collapsible display bin of FIG. 1 in a third configuration, according to one embodiment of the present invention.

Turning to the Figures, FIG. 1-3 illustrate a collapsible display bin 10 including a base 12, sidewalls 14, corner rails 16, a top cap 18, and a shelf 20, according to one embodiment of the invention. Sidewalls 14 are movably coupled with base 12, and corner rails 16, top cap 18, and shelf 20 are movable, for instance collapsible, relative to base 12 to a plurality of different positions to transition collapsible bin 10 between a variety of different configurations, for example, a first or storage configuration as shown in FIG. 1, a second or support table configuration as shown in FIG. 2, a third or platform configuration as shown in FIG. 3, among other variations of the same. Sidewalls 14 are selectively coupled to each other via corner rails 16, which slidably receive first and second, in this case, opposing, longitudinal sides 22 and 24 of adjacent and, in one example, substantially perpendicularly orientated sidewalls 14 to maintain sidewalls 14 extending substantially vertically from base 12 in corresponding ones of the configurations. Corner rails 16 are conversely also slidably removed from adjacent sidewalls 14 to allow sidewalls 14 to collapse in other ones of the configurations of collapsible display bin 10. In this manner, collapsible display bin 10 can be used as a storage container for selectively receiving products (not shown) in some configurations, for example, the first configuration of FIG. 1, and as a platform for supporting products above a floor or support surface (not shown), for example, the second and third configurations of FIGS. 2 and 3. Other configurations and variations thereof are discussed below and more will be apparent to those of skill in the art upon reading the current application.

Figure 4:
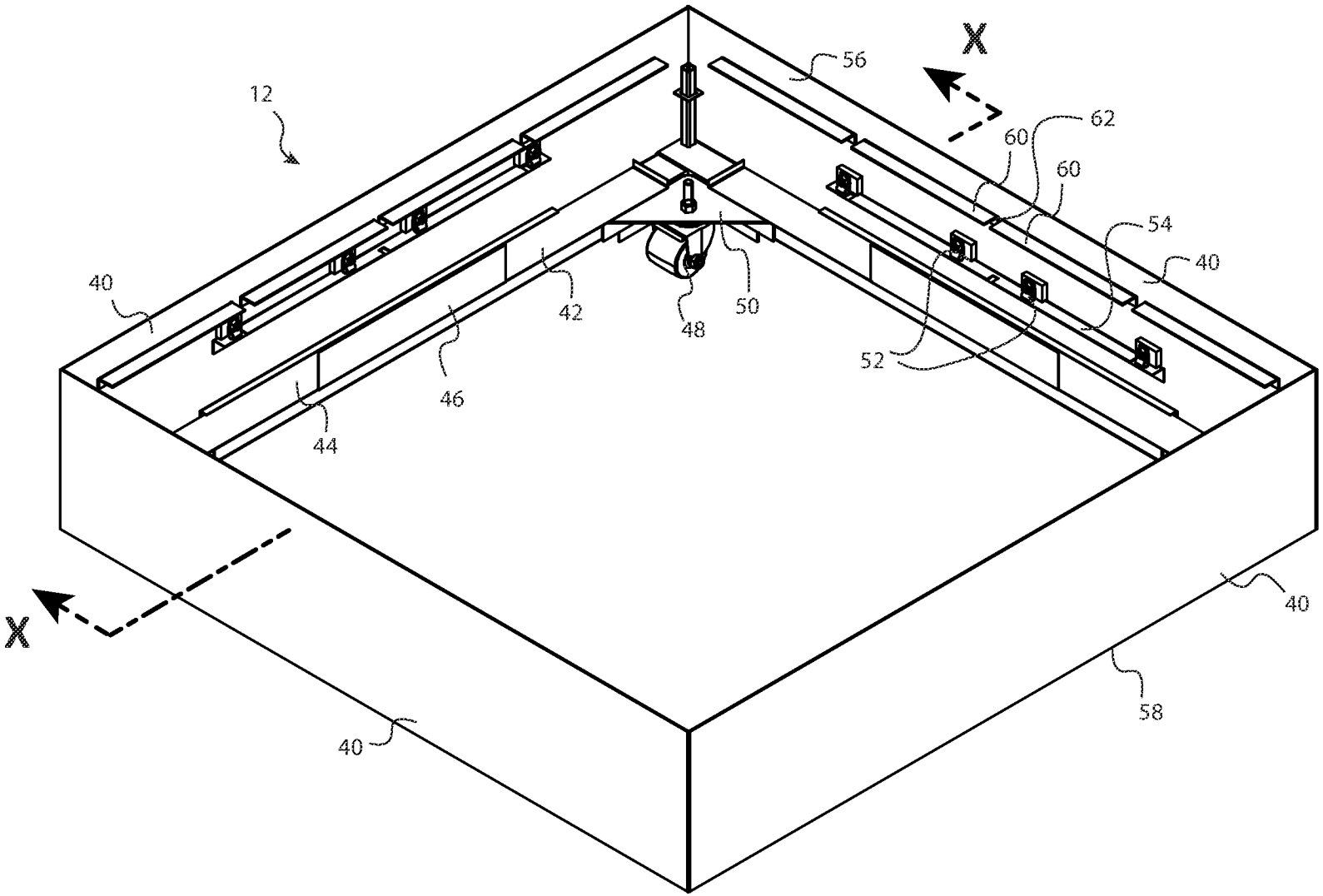
FIG. 4 is a top perspective view illustration of the base of the collapsible display bin of FIG. 1, according to one embodiment of the present invention.

One embodiment of base 12 of collapsible display bin 10 is illustrated in FIG. 4. Base 12 is formed as a hollow, open-ended cuboid formed via four side panels 40 each joined at each end thereof to two different adjacent ones of side panels 40 to form base 12 as an open rectangular structure. In one embodiment, a bottom panel 42 or groups of panels extend substantially around, for example, continuously around, a bottom, inside perimeter of base 12. Bottom panel 42 extends substantially perpendicularly to side panels 40, in one example, as shown in FIG. 4. Side panels 40 and bottom panel 42 can be formed of any substantially rigid and stable material. In one embodiment, side panels 40 and bottom panel 42 are formed of steel, aluminum, other metallic or non-metallic materials and can be formed of a single piece of bent material or separate materials secured to each other, for example, via welding or other suitable means for securement.

Figure 5:
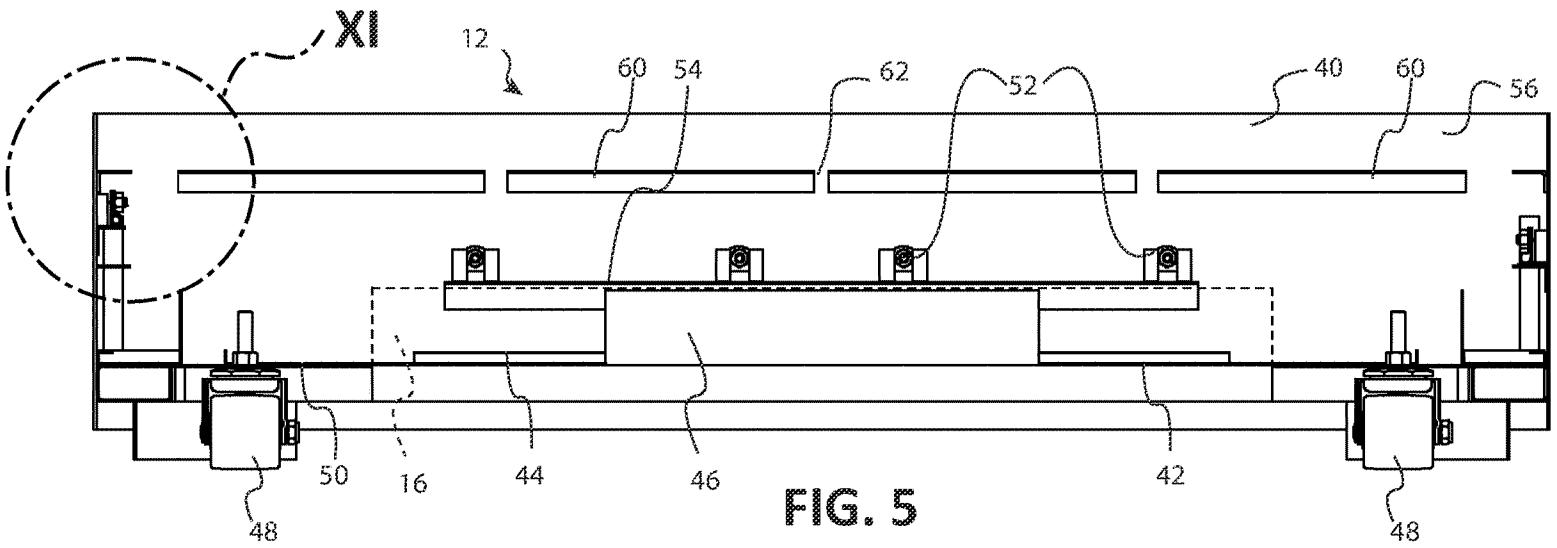
FIG. 5 is a cross-sectional view illustration of a base of the collapsible display bin taken along the line X-X in FIG. 4, according to one embodiment of the present invention.

In one embodiment, each linear length of bottom panel 42 defines a storage shelf 44 for receiving a different one of corner rails 16, to have a general position as indicated in FIG. 5 via broken lines, each adjacent and extending substantially parallel with a different one of side panels 40. Bottom panel 42, which may be formed of material substantially the same as the material used to form side panels 40, is coupled with the adjacent side panels 40, for example, via welding or other means of statically securing storage shelf 44 to side panels 40 as will be apparent to those of skill in the art upon reading the present application. Base 12 includes several vertical retention panels 46, where each vertical retention panel 46 extends upwardly from near an inside edge of bottom panel 42 substantially centered relative to a length of a corresponding and substantially parallel one of side panels 40 to facilitate maintaining each corner rail 16 on the adjacent storage shelf 44. In one embodiment, each of vertical retention panels 46 are formed of a similar material to or a material that differs from components of bottom panel 42.

In one example, base 12 further includes casters 48 coupled to base 12 near each corner thereof, where each corner is defined by two end abutting, adjacent ones of side panels 40, for a total of at least four casters 48. Each caster 48 extends from base 12, such as from a corner extension 50 of bottom panel 42, in a downward direction to contact a support surface or floor (not pictured) therebelow in one embodiment, as will be apparent to those of skill in the art. Each caster 48 may be positioned within a footprint of base 12 to be predominately hidden from view from a position outside of base 12 by side panels 40. Casters 48 collectively allow base 12 and all of collapsible display bin 10 to be more easily moved around a retail setting or other environment to various locations, for instance, as desired for display.

Figure 6:
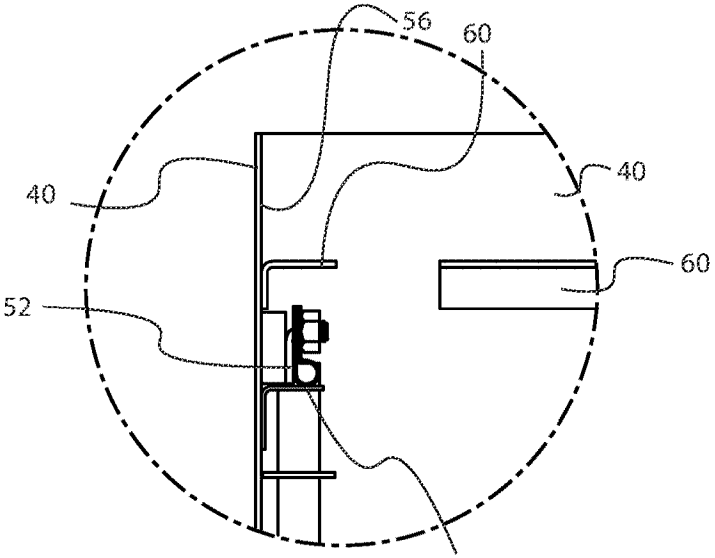
FIG. 6 is a detailed view illustration of a portion of the cross-sectional view illustration of FIG. 5 as indicated by circle XI in FIG. 6, according to one embodiment of the present invention.
Figure 12:
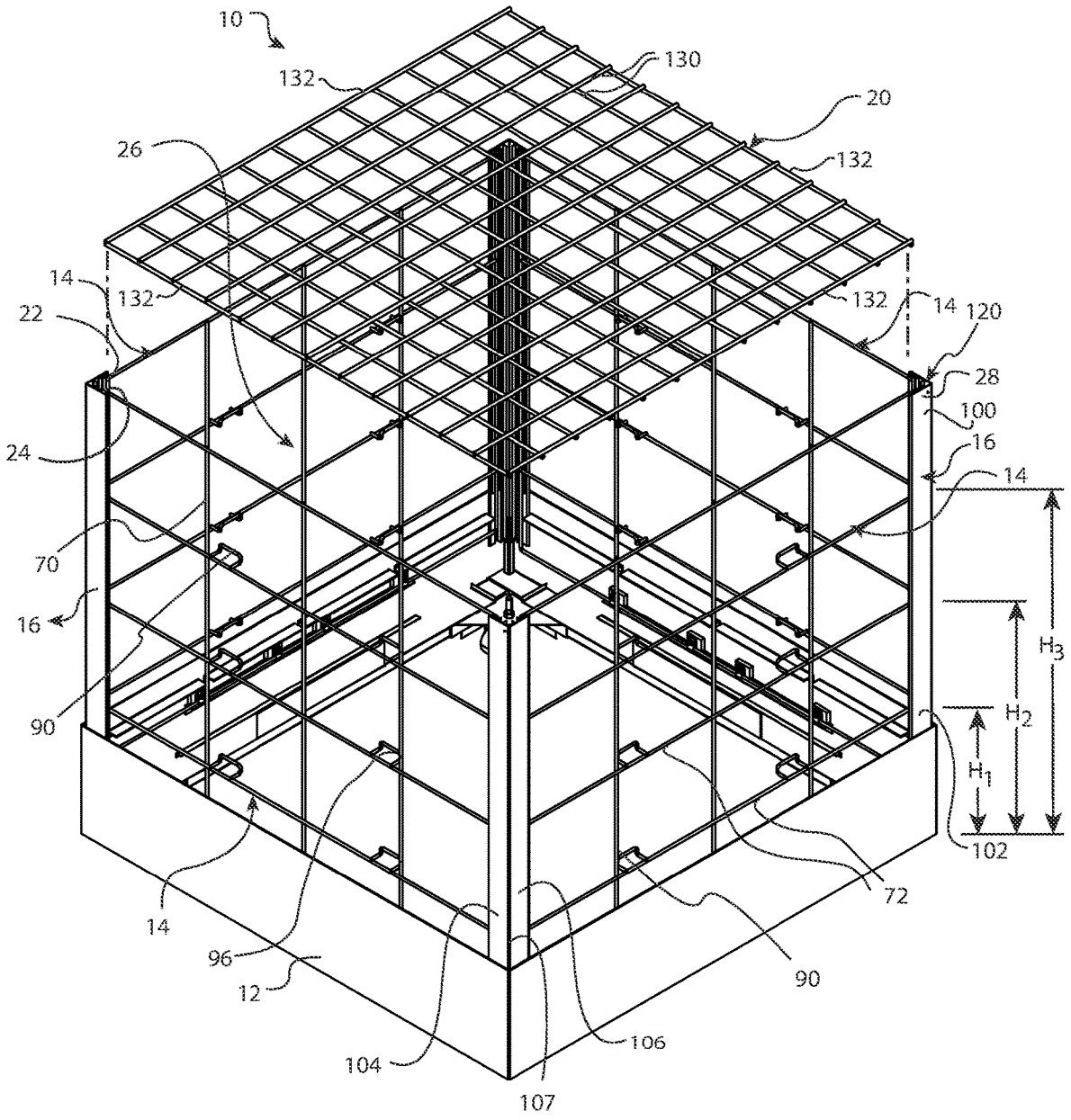
FIG. 12 is a partially exploded, top perspective view illustration of the collapsible display bin portions of FIG. 9 further being assembled with corner rails and a shelf, according to one embodiment of the present invention.

Additionally referring to the cross-sectional and detail views of FIGS. 5 and 6, 12, in one embodiment, further includes a plurality of clamps 52 linearly and longitudinally spaced from each other along and coupled to an inside surface of one of side panels 40. Each of clamps 52 is configured to receive, for example, to wrap around, bottom edge 58 of each sidewall 14 in a manner that allows each sidewall 14 to rotate with each bottom edge 58 serving as a rotational axis for its corresponding one of side panels 40. Each of clamps 52 can be formed in any one of a variety of suitable manners, such as a metal band wrapping around bottom edge 58 of sidewall 14 and being substantially statically secured to the adjacent side panel 40. In one example, a wall guide protrusion 60 extends just below the plurality of clamps 52 to facilitate coupling and/or positioning of each of the plurality of clamps 52 along a height of the corresponding one of side panels 40. In addition, in some instances, support shelf 54 also helps support the weight of each sidewall 14 when in an extended position extending away from base 12, to lessen the forces on and deterioration of each of the plurality of clamps 52. As shown in FIGS. 4-6, base 12 may additionally include wall guide protrusion 60 each extending substantially perpendicularly relative to and inwardly from one of inside surfaces 56 of side panels 40. Wall guide protrusion 60 are configured to form passage slots 62 between extensions of Wall guide protrusions 60 configured to receive portions of sidewall 14, as will be further described below.

Figure 7:
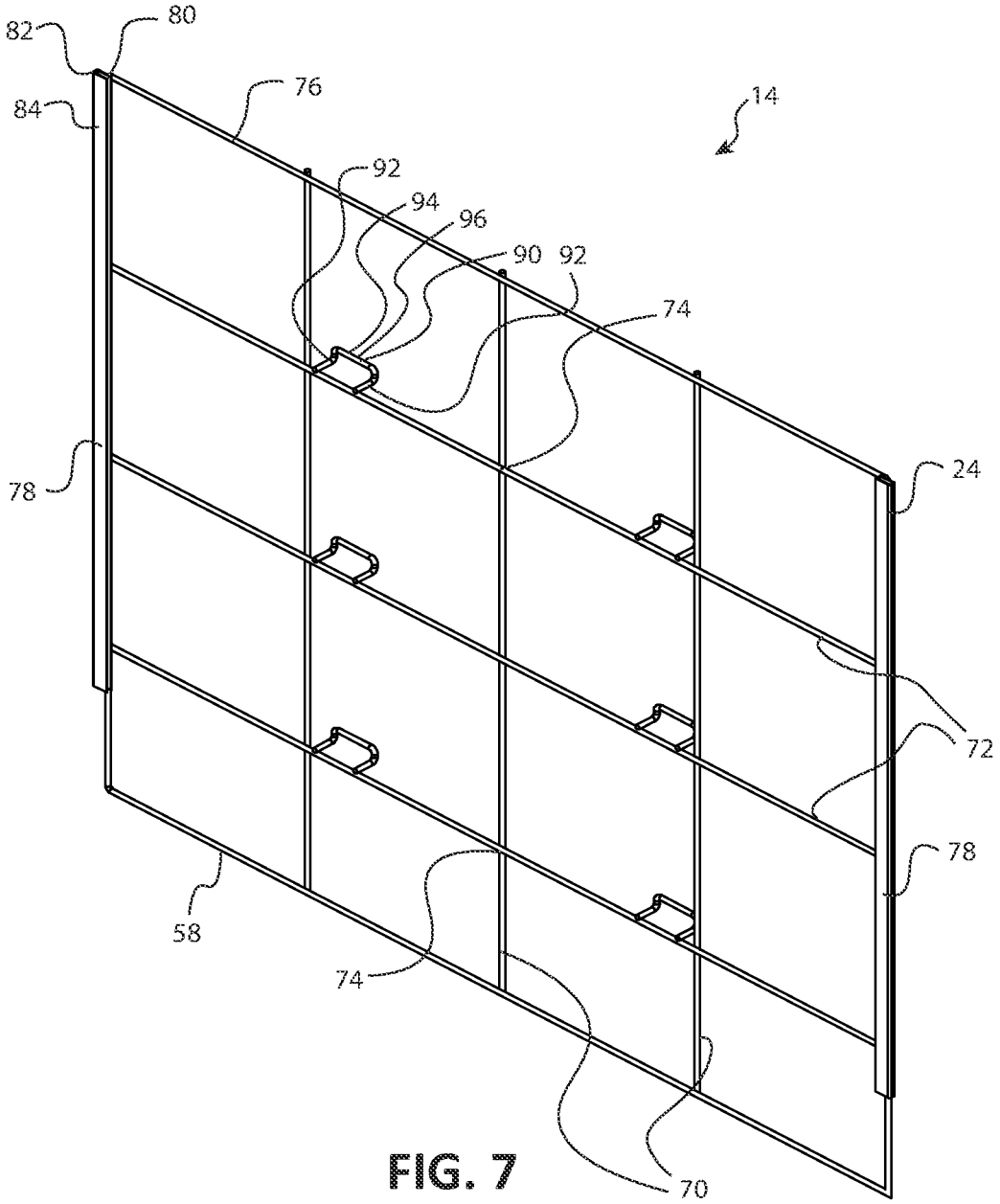
FIG. 7 is a front perspective view illustration of a first side wall of the collapsible display bin of FIG. 1, according to one embodiment of the present invention.

FIG. 7 illustrates one of sidewalls 14 suitable for use as part of one embodiment of the present invention. In one embodiment, each of sidewalls 14 are substantially identical other than minor dimensional and other changes to best facilitate assembly. In other embodiments, each of sidewalls 14 may more significantly differ from one or more other of sidewalls 14. As illustrated, sidewall 14 is substantially rectangular and formed of a plurality of laterally spaced and substantially parallel vertical rods 70 and a plurality of vertically spaced and substantially parallel horizontal rods 72, per one example. Each of the plurality of horizontal rods 72 extend substantially perpendicular to each of the plurality of vertical rods 70 to form each sidewall 14 as a grid. In one example, two of each of the plurality of vertical rods 70 and the plurality of horizontal rods 72 are secured to each other at their intersections 74 via welding or fastener or other suitable method. Each of vertical rods 70 and horizontal rods 72 are elongated members formed of a rigid material with suitable strength to support parts of collapsible display bin 10 and products (not shown) stored in or on display on collapsible display bin 10. In one example, each of vertical rods 70 and horizontal rods 72 is formed of a metal rod, such as steel or aluminum. In other examples, vertical rods 70 and horizontal rods 72 may be formed of metal or other plates or one or more plates (not shown) or other manner as will be apparent to those of skill in the art after reading the present application. In one embodiment, an elongated channel 78 is secured to extend along outside ones of vertical rods 70 via welding, fasteners, and/or other suitable couplings to extend. In this manner, a bottom most one of horizontal rods 72 forms a bottom edge 58 of sidewall 14, and a topmost one of horizontal rods 72 forms 76 of sidewall 14.

Figure 13:
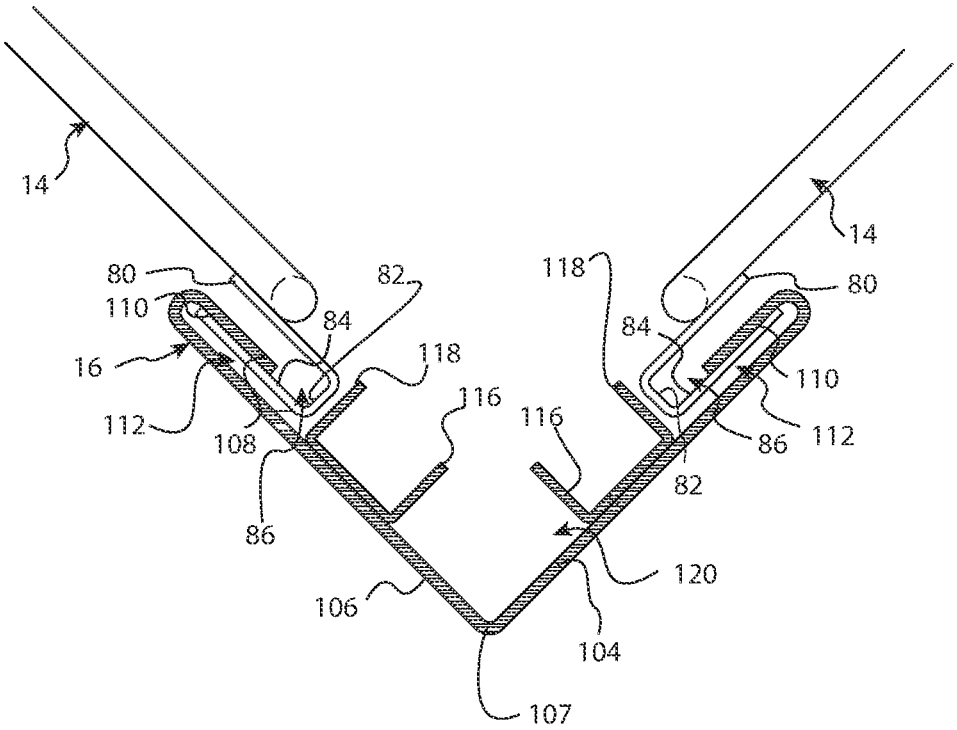
FIG. 13 is a partial bottom view of a corner rail and adjacent sidewalls only of the collapsible bin, according to one embodiment of the present invention.
Figure 14:
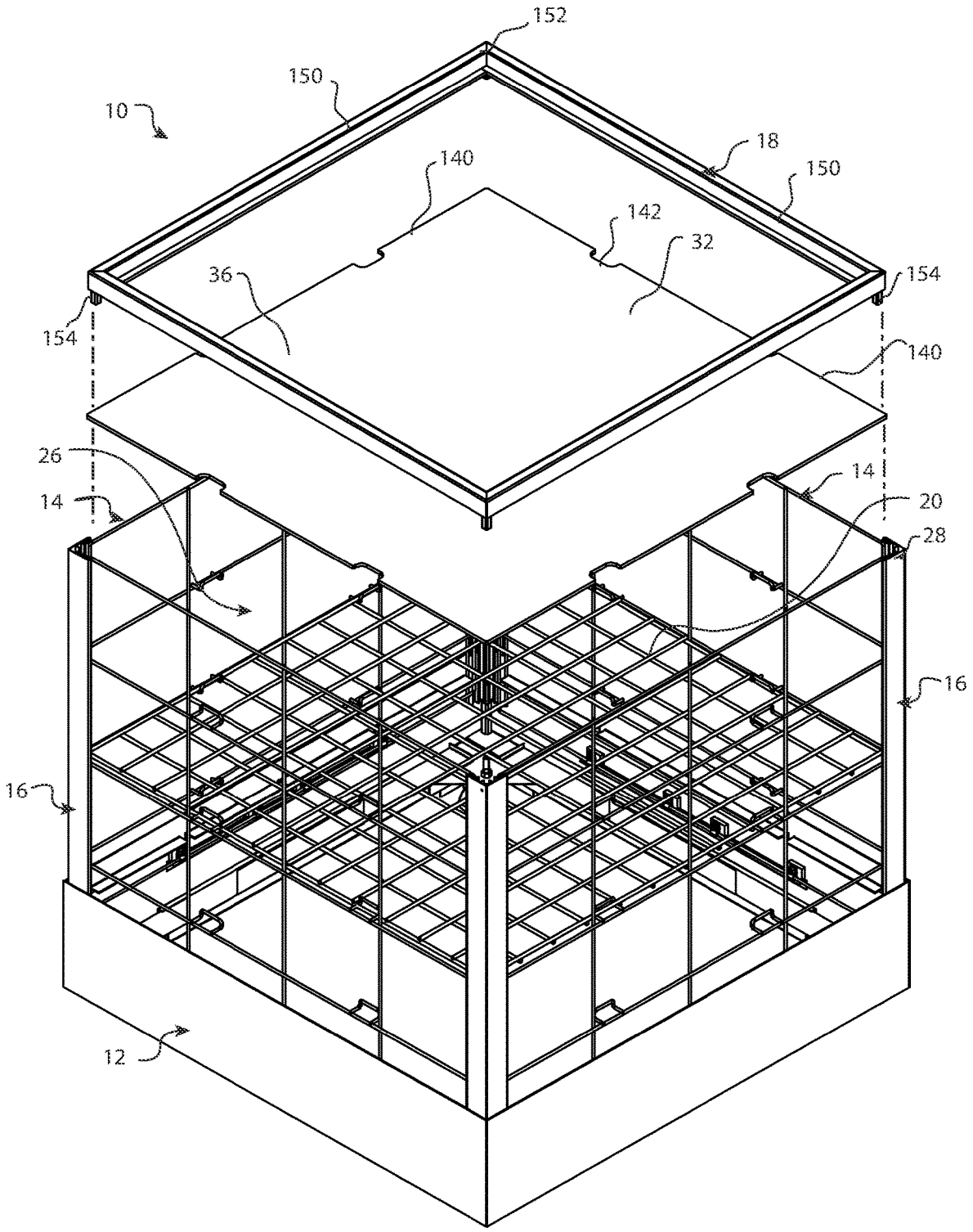
FIG. 14 is a partially exploded, top perspective view illustration of the collapsible display bin portions of FIG. 12 further being assembled with a shelf cover and top cap, according to one embodiment of the present invention.

More specifically, as seen with additional reference to FIG. 13 where each of vertical rods 70 includes a first flange 80, a web 82 extending from one end of one of vertical rods 70 in a direction substantially perpendicular to an extension of first flange 80, and a second flange 84 extending from an end of web 82 opposite first flange 80 and in the same direction as first flange 80 to form an elongated reception slot 86 (see FIG. 13), an outer face of each first flange 80 of elongated channel 78 is secured to an exterior facing surface of an outside one of vertical rods 70 such that web 82 extends outwardly beyond the outside one of vertical rods 70 and a footprint of sidewall 14 as a whole in a direction substantially perpendicular to the extensions of vertical rods 70 and horizontal rods 72. In this manner, elongated channel 78 on one side of sidewall 14 has an opening facing an opening of elongated channel 78 secured to the opposite side of sidewall 14. Each elongated channel 78 forms either the first side 22 or the second side edge 24 of each sidewall 14.

Per the illustrated embodiment and other embodiments of the invention, in one example, one or more of interior one of horizontal rods 72 includes one or more, for example, two or more, shelf support brackets 90 at least initially extending from the corresponding interior one of horizontal rods 72 in a direction substantially perpendicular to the extension of each of vertical rods 70 and horizontal rods 72 in a direction opposite the direction web 82 extends from outside ones of vertical rods 70. Each of shelf support brackets 90 can be formed in any one of a number of manners as will be appreciated by those of skill in the art upon reading the present application, for example, of wire rod, of a solid or perforated plate, among others. As illustrated, in one embodiment, each shelf support bracket 90 is formed in an overall U-shape including opposing side segments 92 and a cross segment 94 extending across and coupled to corresponding ends of side segments 92. Each of opposite side segments 92 is separately coupled to the corresponding one of horizontal rods 72 in a suitable manner such as by welding or other fastener. Each shelf support bracket 90 extends inwardly from its couplings with one of horizontal rods 72 in a manner substantially perpendicular to the extensions of vertical rods 70 and horizontal rods 72, in one example, to extend substantially horizontal relative to the supporting surface or floor of collapsible display bin 10 upon assembly of collapsible display bin 10. In one example of shelf support bracket 90, a cross segment 94 extending between ends of each side segment 92 opposite its coupling with the corresponding one of horizontal rods 72. While in one example, each cross segment 94 is in plane with both of side segments 92, in one embodiment, as shown in FIG. 7, extend upwardly out of a plane including both of side segments 92 to form a lateral movement stop 96 for receiving sidewall 14, as will further be described below.

Figure 8:
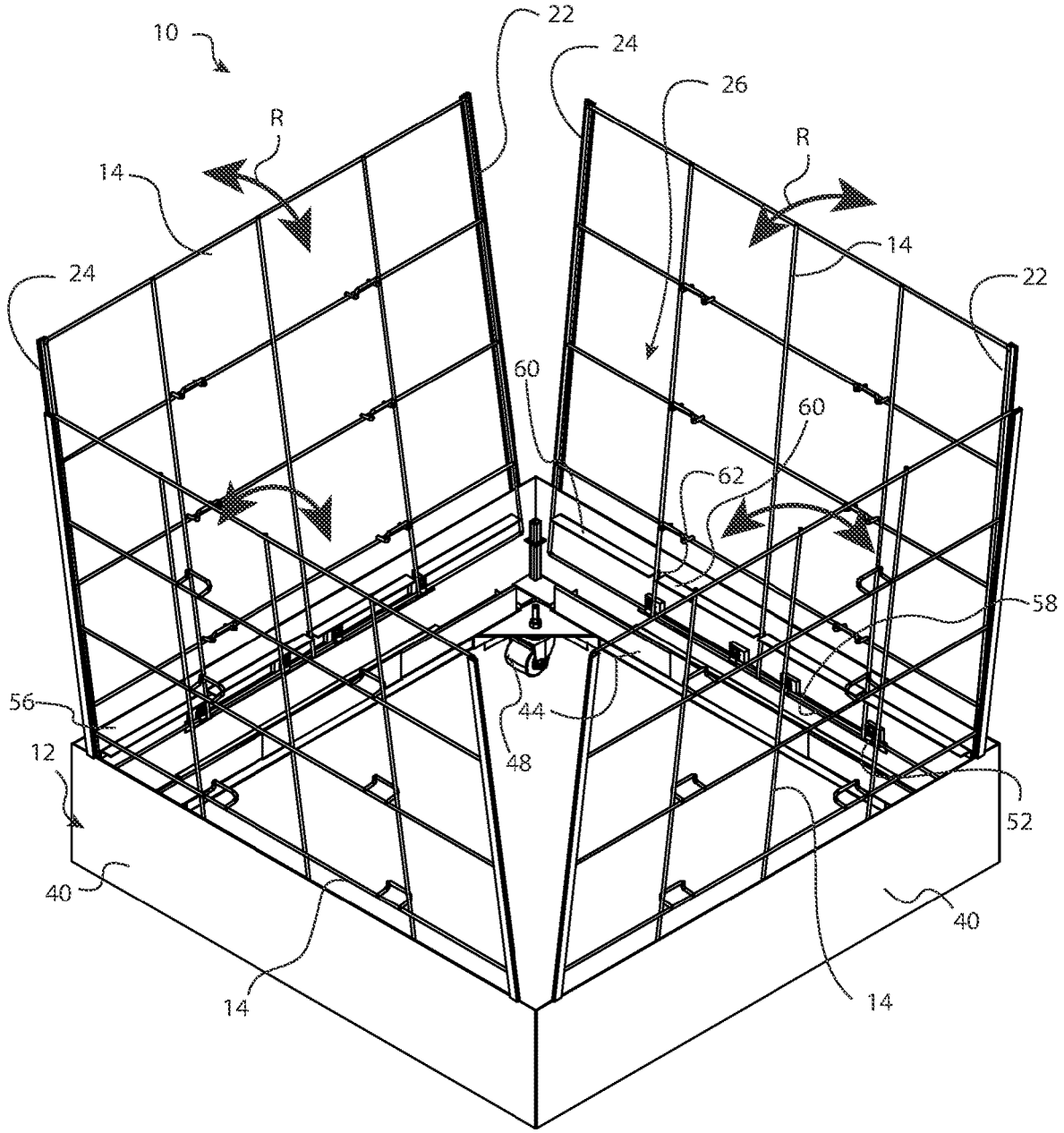
FIG. 8 is a top perspective view illustration of base of FIG. 4 coupled with the sidewalls of FIGS. 7, according to one embodiment of the present invention.
Figure 9:
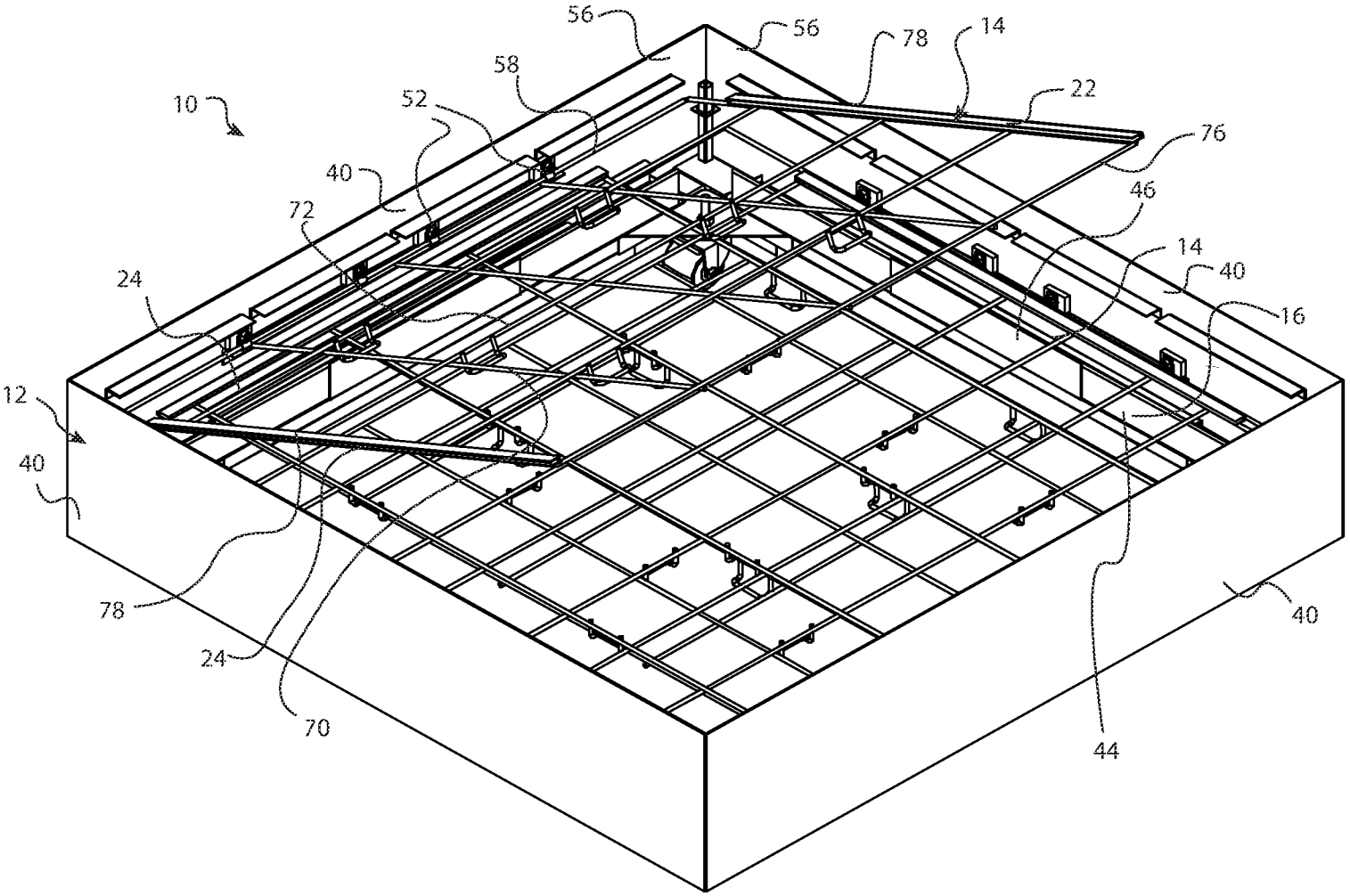
FIG. 9 is a top perspective view illustration of the base and sidewalls of FIG. 8 with the sidewalls being folded into the base, according to one embodiment of the present invention.

As shown in FIG. 8, bottom edge 58 of each of sidewalls 14 is coupled to base 12 via clamps 52 on each of a different one of side panels 40 such that each sidewall 14 is rotatable as generally indicated by arrows R about the corresponding bottom edge 58, in one embodiment. In one example, each clamp 52 wraps at least significantly if not entirely about the one of horizontal rods 72 forming bottom edge 58. In one example, clamps 52 are secured to each side panel 40 at a slightly different height than the other ones of side panels 40 such that when sidewalls 14 are rotated down into the base, each of sidewalls 14 is maintained at a differently level allowing sidewalls 14 to stack upon each other within base 12 as shown with additional reference to FIG. 4. In this embodiment, each of sidewalls 14 may have a slightly different height to accommodate this offset and still results in top edges 76 of side panels 40 all being maintained at the same height when sidewalls 14 are rotated to extend upwardly from base 12. In one example, when sidewalls 14 extend upwardly from base 12, each of one or more vertical rods 70 of each of sidewalls 14 passes through a different one of passage slots 62 between wall guide protrusions 60 on base 12.

Figure 10:
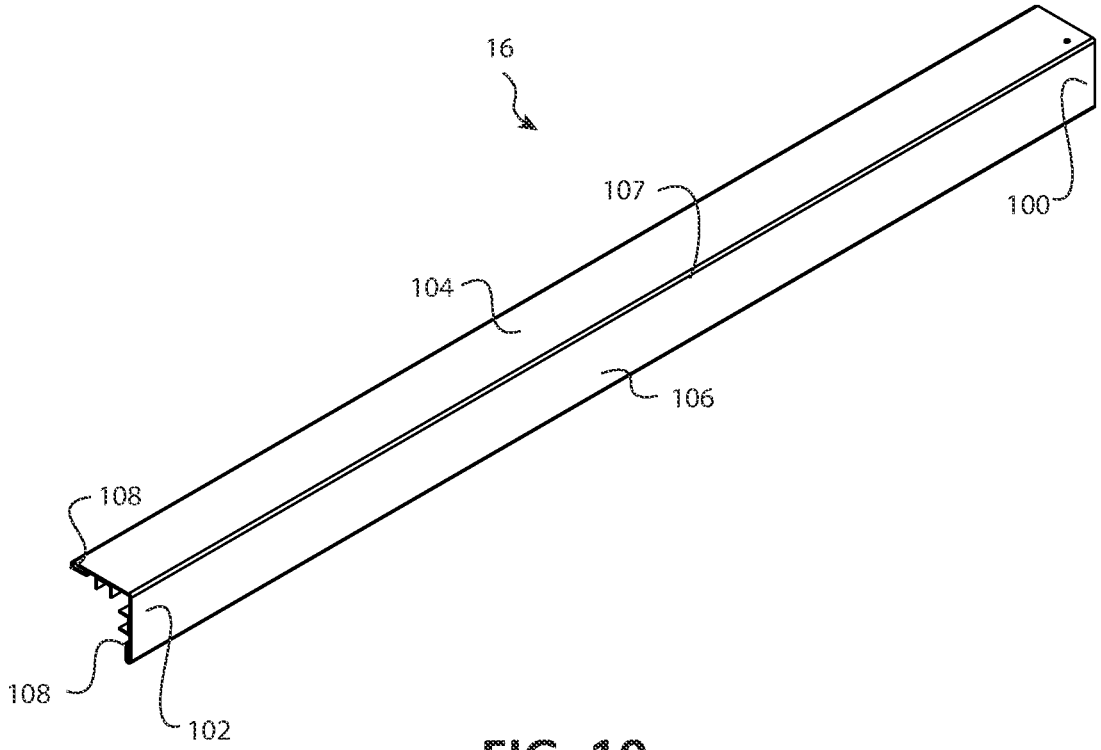
FIG. 10 is a perspective view illustration of a corner rail of the collapsible display bin of FIG. 1, according to one embodiment of the present invention.
Figure 11:
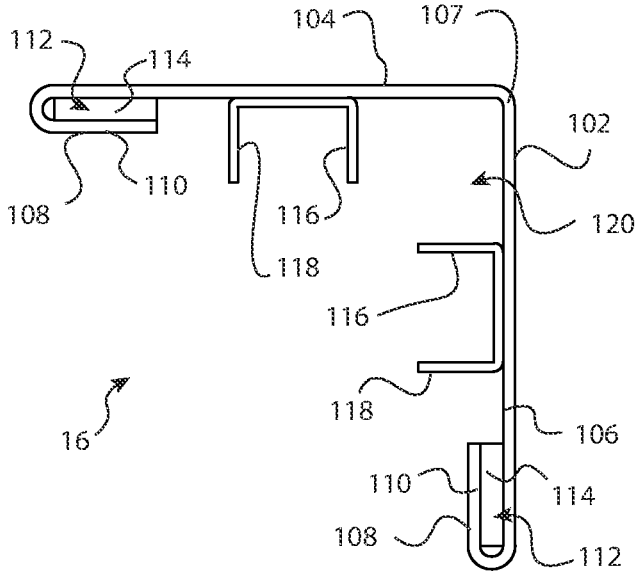
FIG. 11 is a bottom view of the corner rail of FIG. 10, according to one embodiment of the present invention.

As described above, each of sidewalls 14 are selectively coupled to two others of sidewalls 14 via corner rails 16. FIGS. 10 and 11 illustrate one embodiment of a corner rail 16, which is elongated defining and extending between a top end 100 and an opposite, bottom end 102. In one example, each corner rail 16 includes a first planar segment 104 and a second planar segment 106 each extending between top end 100 and bottom end 102 in a planar and elongated manner. First planar segment 104 is secured to second planar segment 106 along elongated edges of each and/or formed as a single piece, such as a metal, i.e., steel or aluminum angle or bent sheet metal to form a corner rail intersection 107. In one embodiment, opposing elongated edges of first planar segment 104 and second planar segment 106, that is the elongated edges opposite 107 of first planar segment 104 and second planar segment 106, terminates in a fairly tight return 108, that is bend of corner rail 16 in a U-shaped manner to form a retaining panel segment extending in a plane that is substantially parallel to a plane in which the corresponding one of first planar segment 104 and second planar segment 106 extends to form a reception channel 112 between each of first planar segments 104 and a corresponding one of retaining panel segment 110 and second planar segments 106 and a corresponding one of second planar segments 106. In one example, a different wall stop 114 covers each reception channel 112 at top end 100 of corner rail 16.

In one example, corner rail 16 includes two sets of retaining flanges where each set includes an inside retaining flange 116 and an outside retaining flange 118. Each set of retaining flanges extend in parallel from one of first planar segments 104 and second planar segments 106 inwardly in a direction perpendicular to the corresponding one of first planar segments 104 and second planar segments 106 a distance shorter than a about half a width of the one of first planar segments 104 and second planar segments 106, in one embodiment. Each inside retaining flange 116 is positioned a similar distance from 107 to form a cap reception area 120 therebetween. Each outside retaining flange 118 is positioned a distance away from inside retaining flange 116 on an opposite side of inside retaining flange 116 than cap reception area 120 and a distance spaced from corresponding reception channel 112.

Each of corner rails 16 are configured to be in two different locations in various configurations of collapsible display bin 10. For example, in the third or storage configuration when sidewalls 14 are collapsed in base 12, each of corner rails 16 are turned on their sides and stored on support shelf 54 along an inside of a different one of sidewalls 14 in base 12 as generally indicated in broken lines in FIG. 5. When collapsible display bin 10 is in an extended configuration in which sidewalls 14 extend upwardly from base 12, each corner rail 16 is configured to slidably receive 122 of one of sidewalls 14 and 124 of an adjacent one of sidewalls 14 to hold each of the two sidewalls 14 in a more vertical configuration and to extend perpendicularly to each other, for example, as shown in FIG. 12. More specifically, in one embodiment, each of corner rails 16 is configured to slidable receive each of 122 and 124, more specifically, a free end portion of second flange 84 of two adjacent sidewalls 14, each within a different one of reception channels 112 thereof, as illustrated in better detail in FIG. 13. When so positioned, in one example, outside retaining flange 118 also serves as a stop preventing undesired translation of a sidewall 14 from being received within reception channel 112 in a direction generally perpendicular to the extension of each corner rail 16. In this manner, each of 13 is only removed from corner rails 16 by sliding corner rails 16 vertically relative to sidewalls 14, in one example.

In one example, shelf 20 is configured to extend across storage chamber 26 to form a bottom thereof. In one embodiment, shelf 20 is sized with an overall footprint substantially the same as an overall footprint of storage chamber 26 to be able to interact with all four of sidewalls 14 at the same time when in a sidewall extended configuration. Shelf 20, in one example, is formed as grid of elongated rods 130 or other extensions bound by outside linear edges 132 each formed by one of elongated rods 130. During assembly, shelf 20 is placed in storage chamber 26 such that each outside linear edge 132 or the one of elongated rods 130 so forming the outside linear edges 132 is placed on at least one, for example, two or more, shelf support brackets 90 of a different one of sidewalls 14 to hold shelf 20 in a substantially horizontal position. In one example, each stop 96 serves to prevent undesired translation of shelf 20 relative to sidewalls 14.

In one embodiment, such as the one illustrated in FIG. 12, where each sidewall 14 includes shelf support brackets 90 at various heights thereof, each corresponding with one of horizontal rods 72, each shelf support bracket 90 is installed at a selected one of the heights by placing each outside linear edge 132 on a shelf support bracket 90 of equal height from a bottom of collapsible display bin 10. For example, as shown in FIG. 12, shelf support brackets 90 are provided at three different heights from a bottom of collapsible display bin 10 generally indicated as $H_1$, $H_2$, and $H_3$. In this manner, shelf 20 can be installed to any one of heights $H_1$, $H_2$, and $H_3$ and later adjusted to any other of heights $H_1$, $H_2$, and $H_3$.

Turning to FIG. 7, following securement of shelf 20 in storage chamber 26, an optional shelf cover panel 32 can be added on top of shelf 20 to provide a solid surface 36 for supporting products (not shown) and/or more aesthetically pleasing appearance to shelf 20. As shown, in one embodiment, shelf cover panel 32 is a solid piece of fairly rigid material that will be well supported by shelf 20 having an overall footprint substantially matching that of shelf 20 and/or storage chamber 26. Shelf cover panel 32 fits in storage chamber 26 to fit on shelf 20, and, in one example, is not further secured to collapsible display bin 10 while, in another example, shelf cover panel 32 is secured to shelf 20 and/or sidewalls 14 in a suitable manner as will be apparent to those of skill in the art upon reading this application. In one example, each of four perimeter edges 140 of shelf cover panel 32 includes cutouts 142 extending into an interior of shelf cover panel 32 sized and shaped to accommodate shelf support brackets 90, more particularly, the upward extension of stop 96 to allow shelf cover panel 32 to more securely fit, substantially flat on shelf 20.

Figure 15:
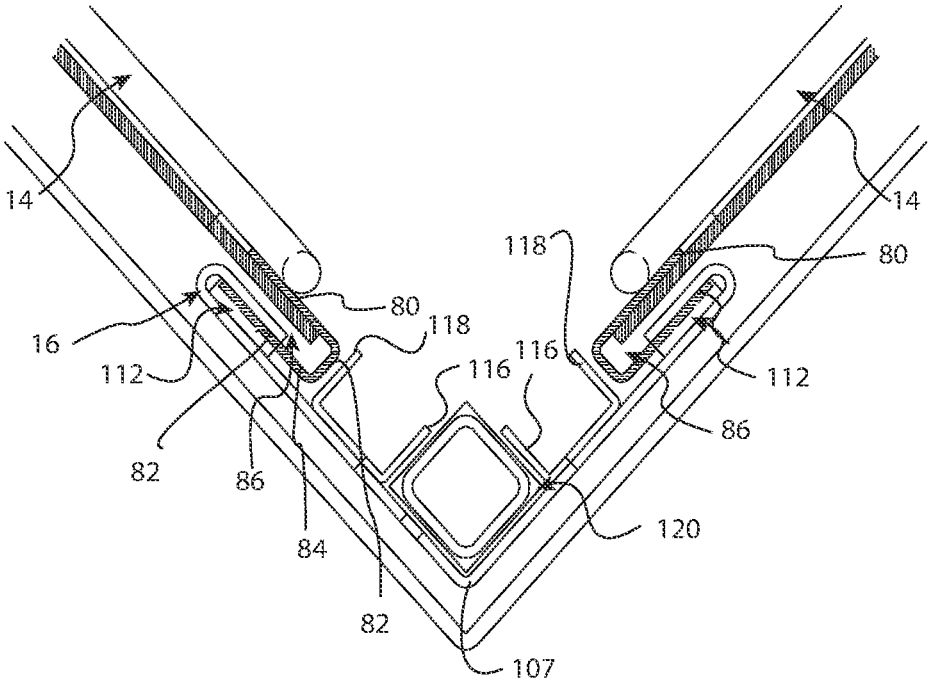
FIG. 15 is a partial cross-sectional view of the collapsible display bin taken along line XII-XII of FIG. 1, according to one embodiment of the present invention.

As described above, top cap 18 is included to finish off collapsible display bin 10 with an aesthetically pleases top edge and in addition serves to discouraged undesired movement of corner rails 16 relative to base 12 or sidewalls 14 during display use by capping top ends 100 thereof. More specifically, top cap 18 is formed with four linear lengths 150 configured to each cover a different one of top edges 76 of sidewalls 14 and to each in combination with an adjacent on of lengths 150 to cover top end 100 of corner rails 16. Corners 152 are formed at the intersection of each of linear lengths 150 with another. In one embodiment, a coupling post 154 extends downwardly from a lower surface of top cap 18 at two or more, in one instance, all four, corners 152 of top cap 18. Each coupling post 154 is configured to and is selectively snugly received within one of the four cap reception areas 120 of corner rails 16, as shown with additional reference to the cross-sectional view of FIG. 15. In one example, top cap 18 includes a downwardly recessed inner support surface 156 extending around an interior perimeter thereof. In one example, base 12 includes a similar post extending upwardly from bottom panel 42 that slides into a bottom of one of the four cap reception areas 120 to facilitate coupling with corner rails 16.

Figure 16:
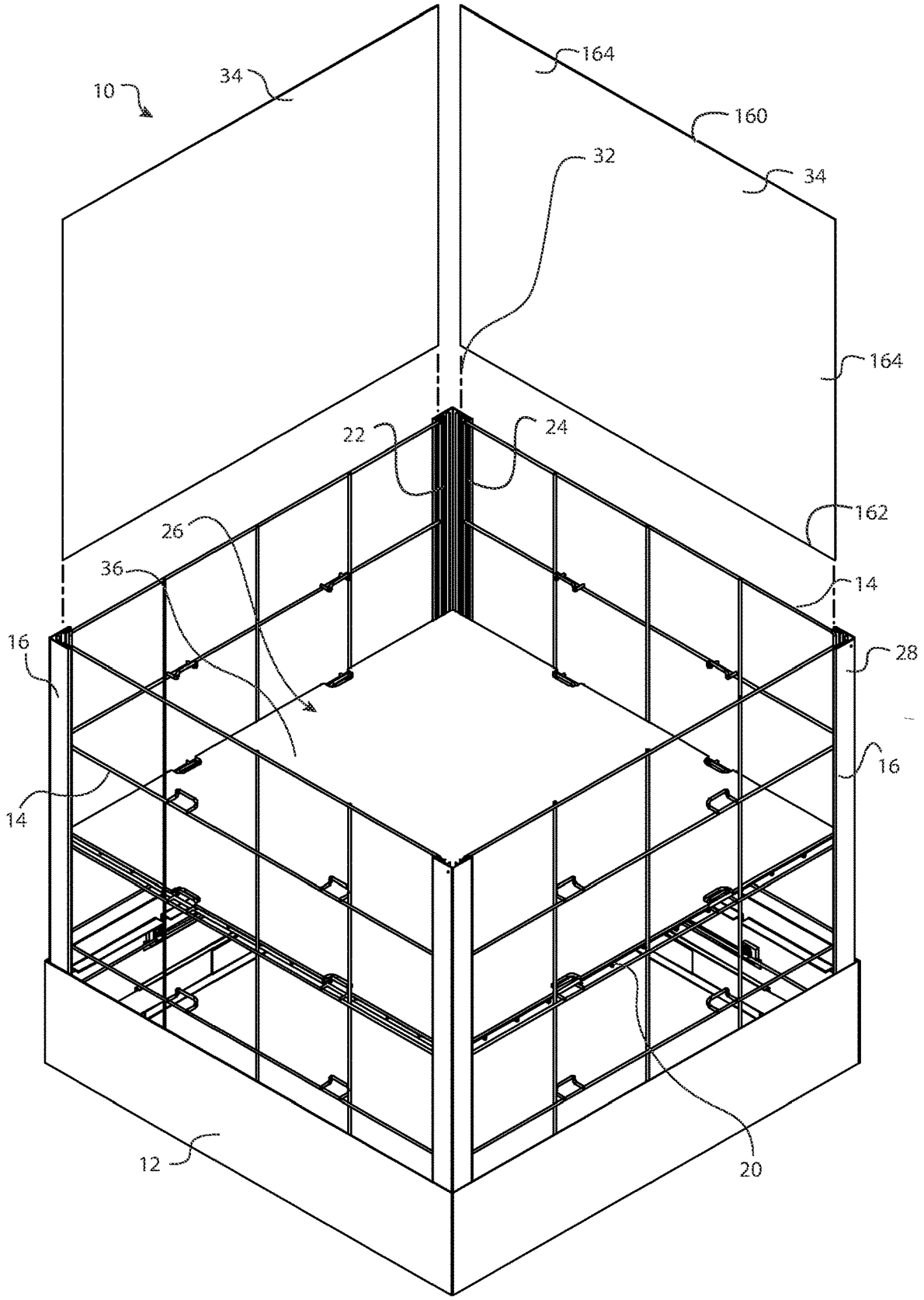
FIG. 16 is a partially exploded, top perspective view of a collapsible display bin of FIG. 12 further being assembled with a shelf cover panel and cladding panels, according to one embodiment of the present invention.
Figure 17:
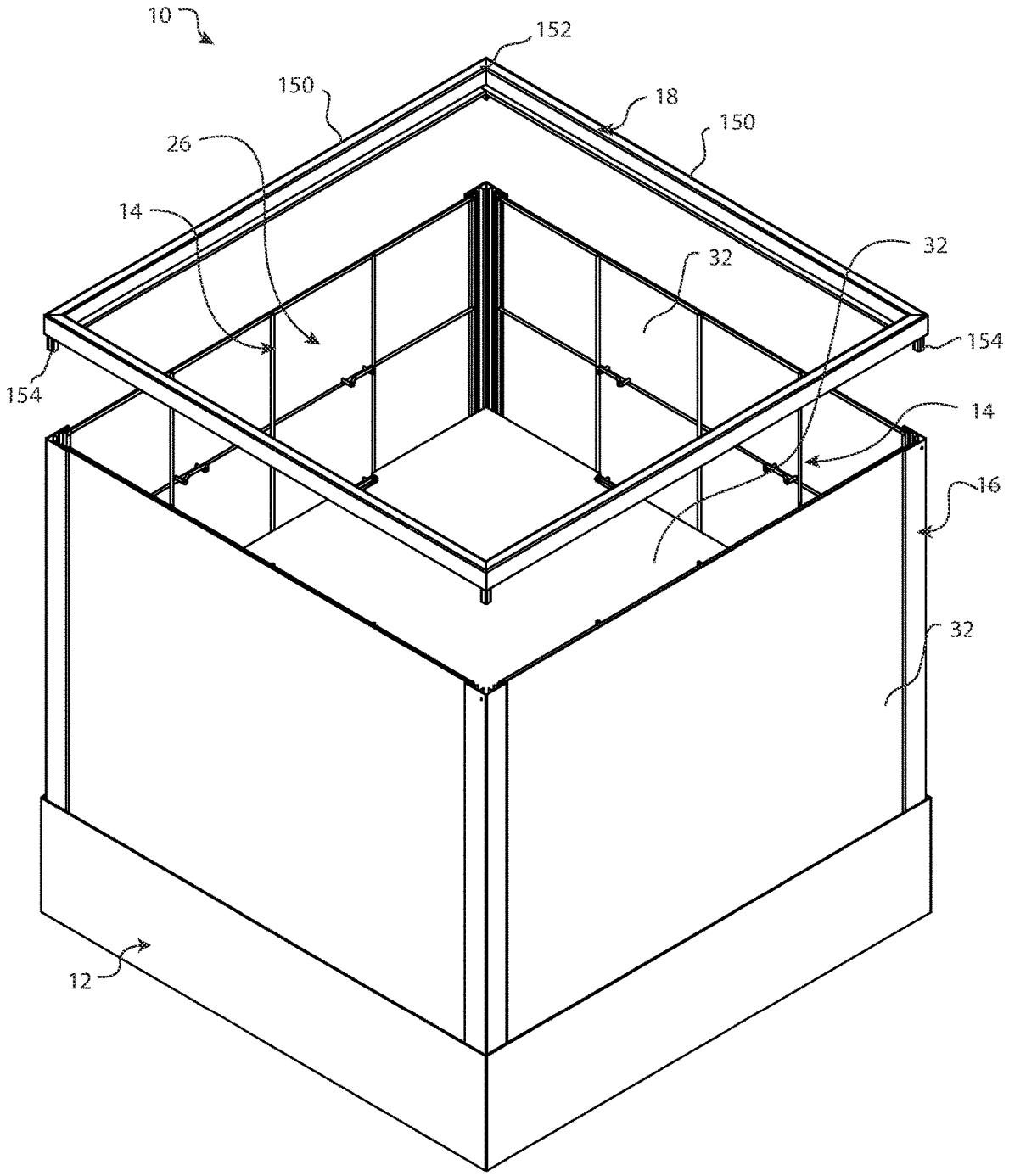
FIG. 17 is a partially exploded, top perspective view of a collapsible display bin of FIG. 16 further being assembled a top cap, according to one embodiment of the present invention.

In one embodiment, to provide collapsible display bin 10 as a more finished and refined display unit, cladding panels 34 are added to collapsible display bin 10. Each of cladding panels 34 is a substantially planar and solid material that may be a solid outer print or include a graphic (not shown) sized to be slightly wider than a space between two adjacent ones of corner rails 16 and to have a height substantially equal to or greater than a distance between a top edge of base 12 and top end 100 of corner rails 16. Each cladding panel 34 defines a top edge 160, a bottom edge 162, and two opposing side edges 164 each extending between different ends of top edge 160 and bottom edge 162. Referring to FIG. 16 and the cross-sectional view of FIG. 15, prior to placing top cap 18 on sidewalls 14 and corner rails 16 as shown in FIG. 12, each cladding panel 34 is placed to slide down and into elongated reception slots 86 of sidewalls 14, for example, with and adjacent to retaining panel segment 110 of corner rail 16. In this manner, the rod grid appearance of sidewalls 14 are concealed from outside view. Once cladding panels 34 are in place, top cap 18 is placed on top of sidewalls 14 and corner rails 16 as described above in one embodiment and as shown, for example, in FIG. 10.

Figure 18:
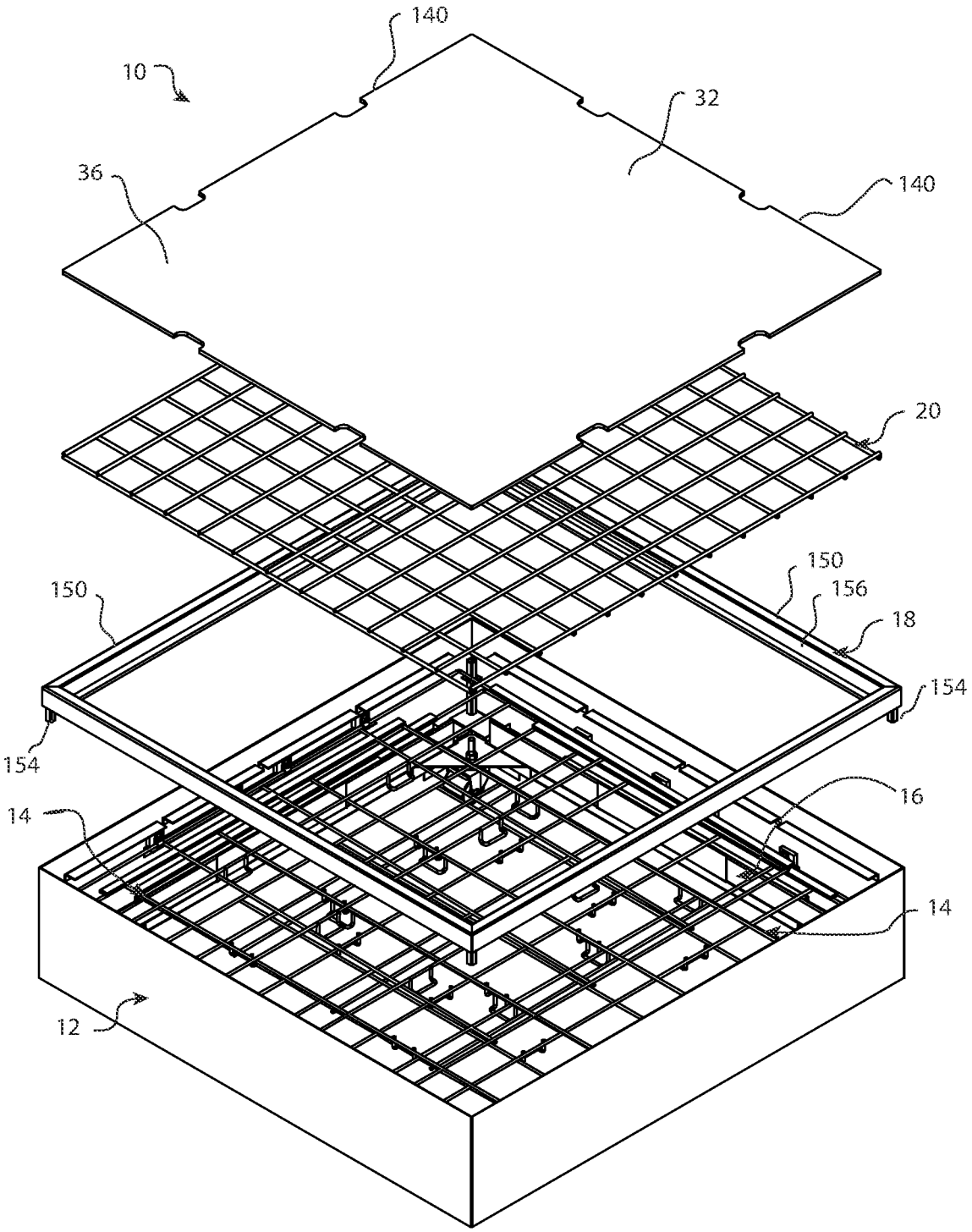
FIG. 18 is a partially exploded, top perspective view of a collapsible display bin of FIG. 1 being assembled into the third configuration of FIG. 3, according to one embodiment of the present invention.

FIG. 18 shows an exploded view of the third configuration of collapsible display bin 10 shown in FIG. 3. In one embodiment of the third configuration, sidewalls 14 are rotated down and stored in base 12, and corner rails 16 are placed in their storage position, that is on storage shelf 44 of base 12, as described below. Next, top cap 18 is placed direction on base 12. The position of corners of base 12 fit snugly around post 154 of top cap 18 to laterally hold top cap 18 in position and cover top edges 76 of base 12. In one embodiment, top cap 18 also at least partially rests on top of Wall guide protrusion 60 extending inwardly from each of side panels 40 to vertically support top cap 18 in place. Shelf 20 is then placed on top cap 18, more specifically to be received and supported by recessed support surface 156 of top cap 18. In one example, shelf cover panel 32 is stacked on top of shelf 20, where the recess defined by recessed support surface 156 of top cap 18 may or may not be deep enough to maintain the stack of shelf 20 and shelf cover panel 32 below a topmost surface of top cap 18.

In view of the examples described above, embodiments of collapsible display bin 10 are formed to allow for ready transition between a large variety of configurations to provide a platform, a table, or a storage bin of various sizes depending upon the height at which shelf 20 is coupled to sidewalls. Collapsible display bin 10 further allows for self-storage of a plurality of components including sidewalls 14 and corner rails 16, for example, when those components are not in active use to decrease needs for storage in a back room, etc. As such, collapsible display bin 10 provides a versatile display fixture that remedies many of the needs in the art while providing an aesthetic pleasing display in each of the variety of configurations.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A collapsible storage bin comprising:

a base having at least two panels coupled to one another;

at least two sidewalls each rotatably coupled to an inside surface of a different one of the at least two panels such that each of the at least two sidewalls rotates from a storage position within the base to a use position extending out of the base, wherein each of the at least two sidewalls includes a first side end and a second side end extending opposite to the first side end, and each of the first side end and the second side end is formed by a channel that is open toward the channel of the other of the first side end and the second side end, and the channel of the first side end defines a first coupling flange, and the channel of the second side end defines a second coupling flange; and at least one corner rails being elongated and including a first planar segment and a second planar segment coupled edge-to-edge to the first planar segment, wherein each of the first planar segment and the second planar segment terminates opposite the other of the first planar segment and the second planar segment with a return to form an elongated reception channel open toward the other of the first planar segment and the second planar segment;

wherein the at least one corner rail selectively and slidably receives the first coupling flange of a first one of the at least two sidewalls within the elongated reception channel formed by the first planar segment and selectively and slidably receives the second coupling flange of a second one of the at least two sidewalls within the elongated reception channel formed by the second planar segment to hold the at least two sidewalls to extend substantially perpendicular to one another from corresponding ones of the at least two panels of the base.

2. The collapsible storage bin of claim 1, wherein when the at least two sidewalls are in the storage position within the base, the at least two sidewalls are stacked on top of one another within the base.

3. The collapsible storage bin of claim 1, further comprising:

a shelf including outside linear edges collectively defining a perimeter of the shelf;

wherein at least one of the at least two sidewalls includes a shelf support bracket for selectively receiving one of the outside linear edges of the shelf when the at least one of the at least two sidewalls is in the use position to selectively maintain the shelf above the base.

4. The collapsible storage bin of claim 1, further comprising:

a shelf including outside linear edges collectively defining a perimeter of the shelf;

wherein the at least two side walls includes four sidewalls arranged to form a storage chamber therebetween with a rectangular cross-sectional shape, and two of the at least two side walls extend substantially parallel to one another and each include one or more shelf support brackets extending into the storage chamber, which supports the shelf to selectively maintain the shelf above the base.

5. The collapsible storage bin of claim 4, further comprising:

a shelf cover panel supported upon and substantially covering a top of the shelf.

6. The collapsible storage bin of claim 1, further comprising:

at least one cladding panel having a top edge, a bottom edge, and opposing side edges each extending between the top edge and the bottom edge of the at least one cladding panel;

wherein the elongated reception channel formed by the first planar segment additional receives one of the opposing side edges of one of the at least one cladding panel.

7. The collapsible storage bin of claim 6, wherein the at least one cladding panel substantially covers one side of the first one of the at least two sidewalls.

8. The collapsible storage bin of claim 6, wherein the at least one cladding panel and one of the at least two panels of the base overlap.

9. The collapsible storage bin of claim 6, wherein:

each of the at least one corner rail comprises a corner reception channel open to a top thereof;

the collapsible storage bin includes a top cap to cover top edges of the at least two sidewalls the top cap including lengths intersecting at corners and a corner post extending downwardly from each corner;

each corner post being sized and shaped to fit into the corner reception channel to selectively couple the top cap to the at least one corner rails.

10. The collapsible storage bin of claim 9, further comprising:

a shelf cover panel set atop and supported by the top cap to cover a storage chamber formed by the at least two sidewalls over the base.

11. The collapsible storage bin of claim 1, wherein each of the at least one corner rails stores in the base during nonuse.

12. The collapsible storage bin of claim 1, wherein:

each of the at least one corner rail comprises a corner reception channel open to a top thereof;

the collapsible storage bin includes a top cap to cover top edges of the at least two sidewalls the top cap including lengths intersecting at corners and a corner post extending downwardly from each corner;

each corner post being sized and shaped to fit into the corner reception channel to selectively couple the top cap to the at least one corner rails.

* * * * *